US008757172B2

(12) United States Patent
Lampugnale

(10) Patent No.: US 8,757,172 B2
(45) Date of Patent: Jun. 24, 2014

(54) COMBINATION NAIL CARE SYSTEM

(71) Applicant: Barbara J. Lampugnale, West Hartford, CT (US)

(72) Inventor: Barbara J. Lampugnale, West Hartford, CT (US)

( * ) Notice: Subject to any disclaimer, the term of this patent is extended or adjusted under 35 U.S.C. 154(b) by 9 days.

(21) Appl. No.: 13/691,935

(22) Filed: Dec. 3, 2012

(65) Prior Publication Data

US 2013/0087163 A1 Apr. 11, 2013

Related U.S. Application Data

(63) Continuation of application No. 12/976,496, filed on Dec. 22, 2010, now Pat. No. 8,322,352, which is a continuation-in-part of application No. 12/460,483, filed on Jul. 20, 2009, now abandoned, which is a continuation-in-part of application No. 11/035,204, filed on Jan. 13, 2005, now abandoned.

(51) Int. Cl.
*A45D 29/18* (2006.01)

(52) U.S. Cl.
USPC ..... 132/74.5; 132/73.5; 132/76.5

(58) Field of Classification Search
CPC ... A45D 29/004; A45D 29/007; A45D 29/06; A45D 29/12; A45D 29/18; A45D 2029/00; A45D 2029/04; A45D 2029/1009; A45D 2029/1036
USPC ..... 132/73, 73.5, 75, 74.5, 313, 314; 206/15.2, 229, 581; 215/6, 10, 234, 215/227, 228; D28/76
See application file for complete search history.

(56) References Cited

U.S. PATENT DOCUMENTS

| | | | |
|---|---|---|---|
| 2,888,020 | A | 5/1959 | Schultz |
| 3,043,316 | A | 7/1962 | Bolser |
| 3,885,578 | A | 5/1975 | Hicks |
| 4,932,802 | A | 6/1990 | Cantone |
| 4,938,347 | A | 7/1990 | Tillman |
| 5,655,554 | A | 8/1997 | Goldberg |
| 5,897,262 | A | 4/1999 | Bratby-Carey |
| 6,059,474 | A | 5/2000 | Huang |
| D449,224 | S | 10/2001 | Kaufman |
| 6,321,937 | B1 | 11/2001 | DeSimone et al. |
| 6,536,453 | B2 | 3/2003 | Vanden Dries et al. |
| 6,712,537 | B2 | 3/2004 | Hung |
| 2003/0127104 | A1 | 7/2003 | Tyre |
| 2005/0166937 | A1 | 8/2005 | Taft |
| 2006/0102580 | A1 | 5/2006 | Betras |

*Primary Examiner* — Rachel Steitz
(74) *Attorney, Agent, or Firm* — Alix, Yale & Ristas, LLP

(57) ABSTRACT

A multi purpose fluid container for an integrated makeup kit, particularly an integrated nail makeup kit, nail polish, a polish applicator brush, nail file, nail polish remover solvent, and nail polish remover pads are combined in a convenient size and shape for facile transport in a modestly sized purse or handbag, but which can quickly and easily be separated into a nail polish applicator bottle with brush, a nail file, and a jar containing a plurality of nail polish remover pads saturated with solvent. When separated, the bottles and jar can rest on a flat surface, or be readily held in one's hand, such that the bottles and jar can be used independently of each other, in any sequence or order, without danger of spillage or contamination, and the nail file can be utilized independently from the bottle and jar.

19 Claims, 8 Drawing Sheets

COMBINATION NAIL CARE SYSTEM

CROSS REFERENCE TO RELATED APPLICATION

This application is a continuation of U.S. patent application Ser. No. 12/976,496, filed Dec. 22, 2010, which is a continuation-in-part of U.S. patent application Ser. No. 12/460,483, filed Jul. 20, 2009, which is a continuation-in-part of U.S. patent application Ser. No. 11/035,204, filed Jan. 13, 2005, the contents of which are herein incorporated by reference in their entirety.

BACKGROUND OF THE INVENTION

The present invention is directed to personal makeup products, and in particular, to an improved nail polish applicator.

For many years women have purchased bottles of nail polish having a cap with brush wand, which enables them to colorize their nails in the convenience of their homes while also permitting them to take the bottle with them it in a purse or the like, for touch up as needed while outside the home. However, the proper application of nail polish for achieving a smooth, glossy finish, requires that all polish previously applied to the nails be fully removed. While at home, a woman will typically have a separate bottle of nail polish removing solvent and abrasive pads, amongst other tools for this purpose.

Whereas carrying a nail polish bottle in a purse for touch up does not represent a significant inconvenience, having only the nail polish available for use outside the home limits the circumstances under which the polish can be effectively applied outside the home. Most women would not go to the trouble of placing a nail polish bottle, a polish remover bottle, and a package of removal pads into what in current times is frequently a very modestly sized purse.

For many women, especially those who are outside the home for long periods during the day and must look their best throughout the day, the maintenance of perfectly defined, smooth, shiny nail coloring is an ongoing nuisance.

SUMMARY OF THE INVENTION

Accordingly, it is an object of the present invention, to provide a multi purpose fluid container for an integrated makeup kit, particularly an integrated nail makeup kit, wherein the nail polish, polish applicator brush, nail polish remover solvent, and nail polish remover pads are combined in a size and shape that is easily carried in a modestly sized purse or handbag, but which can quickly and easily be separated into a conventional nail polish applicator bottle with brush, and a jar containing a plurality of nail polish remover pads saturated with solvent.

When separated, each of the bottle and jar can rest on a flat surface, or be readily held in one's hand, such that each can be used independently of the other, in any sequence or order, without danger of spillage or mutual contamination.

In another embodiment, a removable nail file is incorporated into the multi purpose container. When the bottle and jar are separated, the nail file can be easily accessed and utilized independently from the bottle and jar, while the bottle and jar can be operated as described above.

BRIEF DESCRIPTION OF THE DRAWINGS

The preferred embodiments of the invention will be described in further detail with reference to the accompanying drawing, in which:

FIG. 1 is an elevation view of the integrated multi purpose bottle and makeup kit, in the fully closed condition as would be carried in a hand bag or the like;

DESCRIPTION OF THE PREFERRED EMBODIMENT

Figure 2:
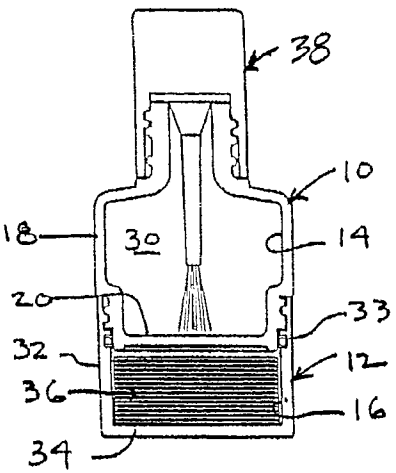
FIG. 2 is a section view of the integrated multi purpose makeup kit in the fully closed condition corresponding to FIG. 1.
Figure 1:
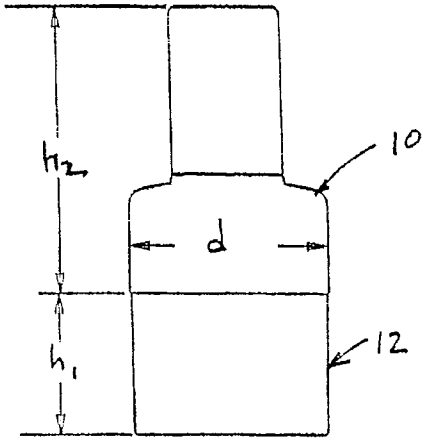

FIGS. 1-4 show a multi purpose fluid container in the form of an integrated nail makeup kit comprising an upper container 10 and a lower container 12, which define an upper chamber 14 and a lower chamber 16, respectively. The upper container 10 would typically have a cylindrical sidewall 18 and a circular bottom wall 20 which fluidly isolates the upper chamber 14 and from the lower chamber 16. The lower end or base of the upper container 10 at bottom wall 20 preferably has a flange or rim 22 with internal threads that mate with external threads on a neck 24 that extends from an annular shoulder at the periphery of the upper end of the lower container 12.

The upper container 10 has an access aperture 26 formed as a bore through an externally threaded neck 28 extending from the top wall. In the preferred product as marketed to consumers, the upper chamber 14 is substantially filled with one form of makeup fluid 30, in particular, nail polish. The lower chamber 16 holds a different form of makeup that would be used in conjunction with the makeup in the upper chamber. In particular, the lower chamber holds a plurality of pads 36 saturated with any conventional solvent for nail polish. The lower container 12 preferably has a substantially cylindrical sidewall 32 and flat circular bottom wall 34. The top need not have an upper wall, but rather is preferably open. The bottom wall 20 of the upper container 10 completes the encapsulation of the chamber 16 and thus maintains fluid isolation between chambers 14 and 16 when the upper and lower containers are secured together at the threaded interface 22, 24.

Because the solvent in the lower chamber 16 is typically highly volatile, a secure seal should be formed at the confronting surfaces of the lower side of the wall 20 against the rim of the neck 24 of the lower container 12, or at the tight engagement of the threaded interface 22, 24. For example, a resilient annular gasket or the like could be glued to the rim of the neck 28 of container 12, or the entire underside of the bottom wall 20 could be formed of a resilient gasket material. Moreover, a resilient O-ring 33 could also be located at the confronting surfaces at the bottom of the rim 22 of the upper container 10 and the shoulder at the upper periphery of the lower container 12. One of ordinary skill in the art could readily design these confronting components in relation to the engagement of the threads to assure that the threads do not engage to the limit before the seal is effectuated.

The cap 38 has a cylindrical or substantially frustoconical handle 40 that is partially hollow such that a stem or wand 42 extends longitudinally from within the handle to a polish applicator brush or the like 44. At the base of the handle 40, internal threads 46 are provided at a diameter for engaging the external threads on neck 28, in a manner that is typical of conventional nail polish bottles.

Figure 3:
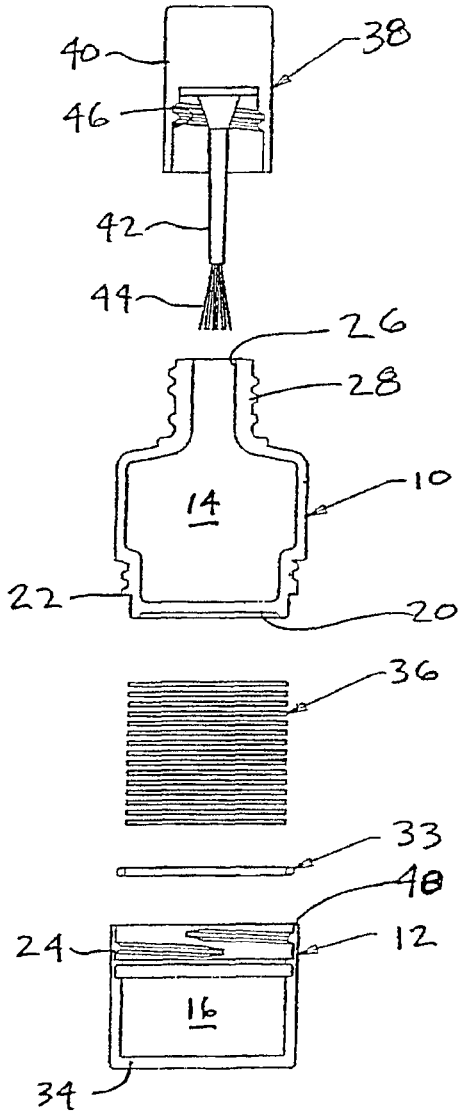
FIG. 3 is an exploded section view of FIG. 2.

As may be appreciated from FIGS. 2 and 3, the threaded brush cap 38 is selectively attachable to the neck 28 for opening and closing the aperture 26. The brush 44 enters the chamber 14, which encloses a first working volume, when the cap is attached to the neck and is entirely removed from the first working volume when the cap is detached from the neck. The lower chamber 16 partially encloses a second working volume such that when the threads 22, 24 are engaged the top 48 of the lower chamber 16 is closed by the bottom wall 20 of the upper chamber and when the threads are disengaged the lower container 12 separates from the upper container 10 whereby the second working volume is exposed through the open top 48. Clearly, whether the containers 10, 12 are secured together as in FIG. 1 or detached as in FIG. 3 or 4, the working volume 14, 16 and thus the nail polish 30 and the polish remover pads 36 are always isolated from each other.

Figure 4:
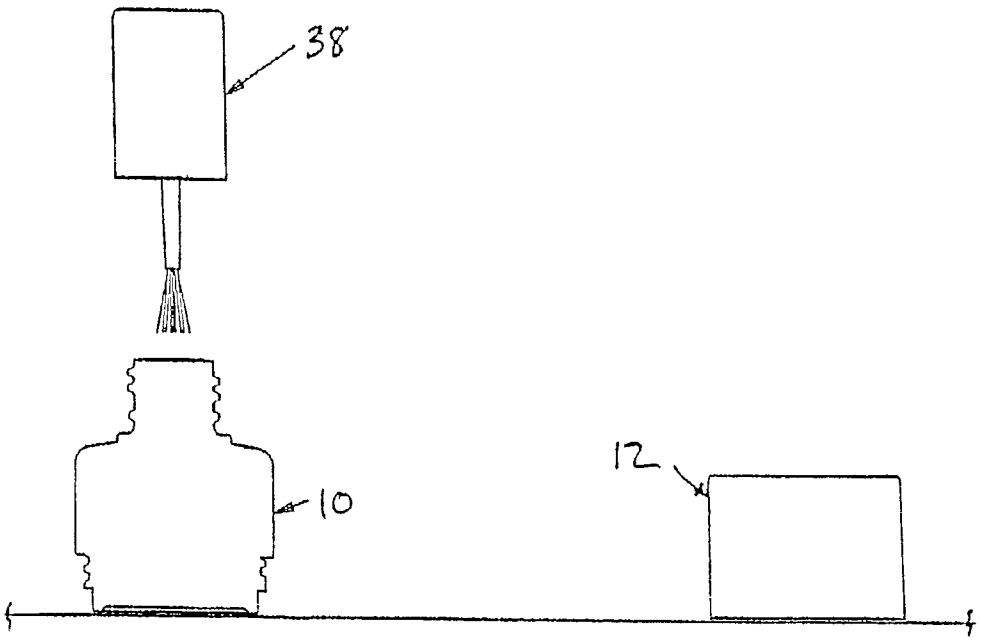
FIG. 4 shows the separated bottles or jars each resting on a flat surface that facilitates independent use.

It should be appreciated that the composite makeup kit, particularly the combination of nail polish applicator bottle 10 and nail polish removal jar 12, can readily be grasped in the hands and detached from each other for use, as shown in FIGS. 2 and 4. FIG. 4 shows one subsequent step by which the user has placed the upper container or bottle 10 on a flat surface for ready access to the brush cap 38 while the other container or jar 12 for the saturated pads 36 is on the same flat surface nearby. The base of each container 10, 12 should be flat or effectively flat for this purpose. Because the solvent that saturates the pads 36 is volatile, the user may wish to remove one or two pads 36, and then reassemble the containers 10, 12 before using the pads for removing previously applied polish from a portion of one nail, one entire nail, or all nails in the fingers of one hand. The cap 38 can then be removed from the upper container for applying polish while the pads 36 remain in a fluidly sealed environment.

It should also be appreciated that the number of nails from which polish can be removed by the inventory of pads 36 in chamber 16, may differ from the number of nails that can be polished by the inventory of polish 30 in upper chamber 14. This difference would most likely occur because all the pads 36 would be utilized before all of the polish 30, or, due to the volatility of the solvent, some of the pads would become ineffective for removing polish. If the latter condition occurs, the user at her convenience at home, could easily detach the upper and lower containers 10, 12 and pour solvent into chamber 16 through the open end 48 thereby replenishing the effectiveness of the pads. Furthermore, replacement pads can be made available as an after market item, provided they have the same area foot print as the cross section of the chamber 16.

Although many configurations of the upper container 10 and lower container 12 and their inter-engagement are within the scope of the present invention, in the preferred embodiment, the overall shape is cylindrical with a length of the composite bottle (without cap) of approximately 2-4 inches, and an outer diameter or equivalent cross sectional dimension between opposed walls in the range of about 1-2 inches. The overall axial length of the upper container 10 and the lower container 12 are about equal and in most instances would not differ by more than a 60%-40% ratio. For an example with reference to FIG. 1, the overall height $h_1$ of the lower bottle is preferably 1.0-1.5 inch, the overall height $h_2$ of the upper bottle including cap is preferably 2.0-2.5 inch, and the outer diameter d is about 1.5 inch. The cross section would typically be circular, but other cross sectional shapes such as oval, rectangular, or other polygon are also possible. It is not necessary that the cross sectional shape of the upper and lower containers 10, 12 or working volumes 14, 16 be identical. As a practical matter, the diameter of chamber 16 or similar cross dimension of a non-circular chamber, should be large enough to receive a pad that is large enough (e.g., at least ¾ in diameter) to be easily used for removing previously applied polish.

Figure 5:
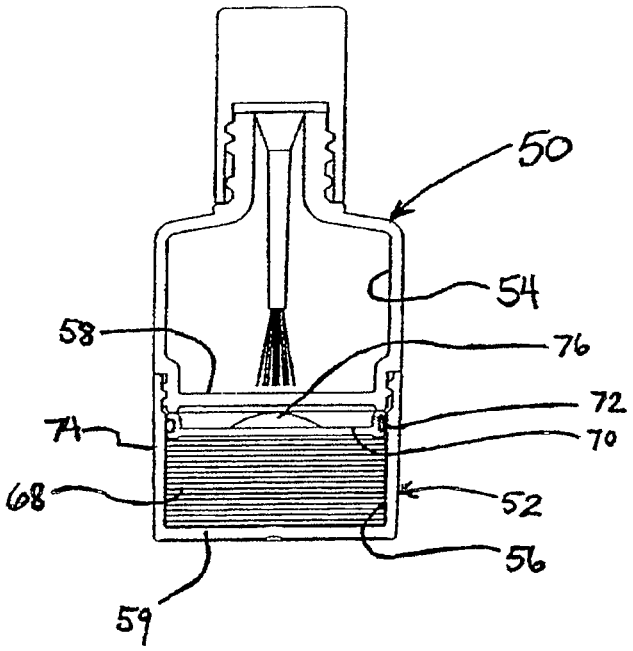
FIG. 5 is a section view of another embodiment of the multi purpose makeup kit in the fully closed condition.
Figure 6:
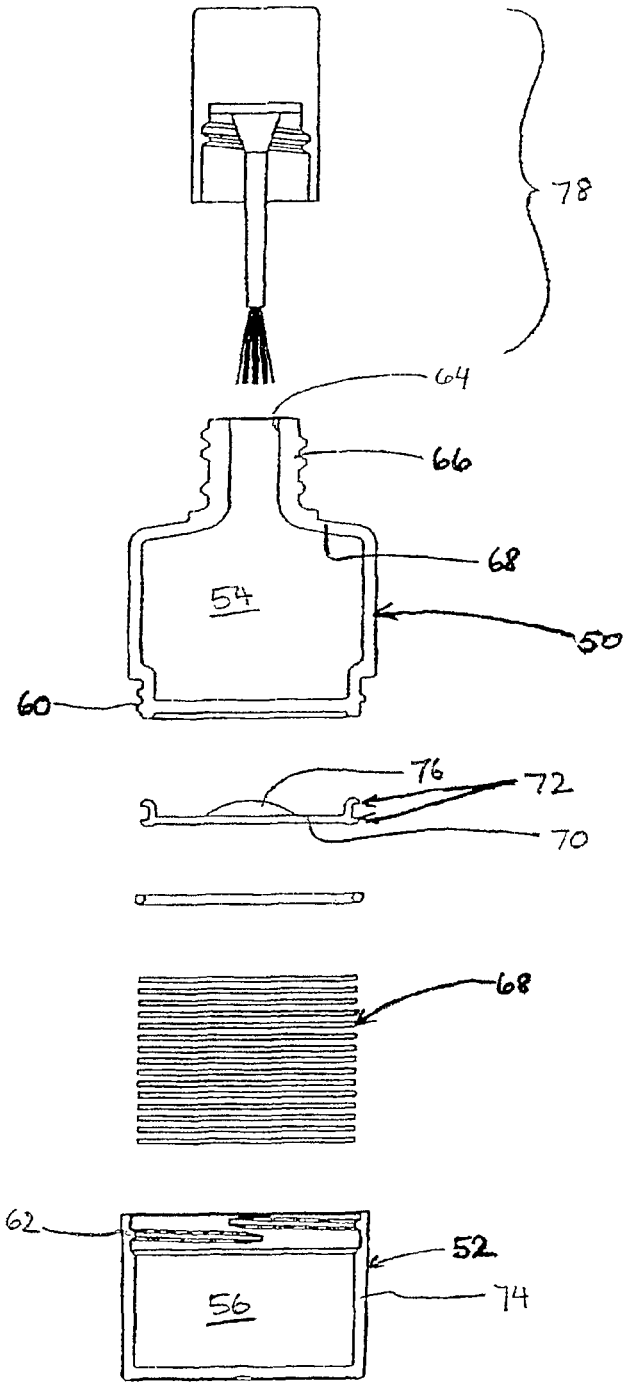
FIG. 6 is an exploded section view of FIG. 5.

FIGS. 5 and 6 depict another embodiment of the multi purpose fluid container kit. This embodiment also comprises an upper container 50 defining an upper chamber 54, and a lower container 52 defining a lower chamber 56. The upper container 50 and lower container 52 can be formed generally identical to the upper and lower containers, 10 and 12, in the previously disclosed embodiments. Preferably, the lower end or base of the upper container 50 at the bottom wall 58 has an externally threaded rim 60 configured to mate with the internal threads on the neck 62 of the lower container 52. Preferably, both of the upper and lower bottom walls, 58 and 59, are effectively flat.

As in the previous embodiments, the upper container 50 has an access aperture 64 formed as a bore through an externally threaded neck 66 extending from the top wall 68. The upper chamber is configured to receive a longitudinally extending applicator wand attached to a frustoconical handle (represented collectively as reference numeral 78 in FIG. 6). Preferably, the upper chamber 54 holds makeup, such as nail polish, and the lower chamber 56 holds a plurality of pads 68 saturated with nail polish solvent.

Unlike the embodiment of FIGS. 1-4, this embodiment has a removable impermeable cover 70 that is positionable within the inner boundaries of the lower container side wall 74. The cover 70 is a fluid-impermeable unit that is configured to isolate the pads and solvent in the lower chamber 52 from the external environment, including the bottom wall 58 of the upper container when the container kit is in the closed condition (FIG. 5). The cover 70 is generally circular and defines an outer radial edge and top and bottom surfaces. The top surface is preferably fit with a manually gripable dome shaped handle 76. As depicted, the outer radial edge of the cover 70 comprises a pair of flexible lips 72. Thus, when engaged, the cup seal isolates the solvent and pads from the external environment, including the outer surface of the bottom wall 58.

In an alternate embodiment, the lips can be configured to engage an O-ring or like unit to enhance the isolation between the pads and the outer environment (not shown). When the cup seal 70 is positioned within the lower cavity 56 above the pads 68, the O-ring is compressed by the side wall 74, resulting in effective pressure on the inner surface of the side wall 74.

Similar to the FIGS. 1-4 embodiment, a user can detach the nail polish applicator bottle 50 and nail polish removal jar 52. Due to the effective flatness of the respective bottom walls, 58 and 59, the applicator bottle and nail polish removal jar can each be placed on a relatively flat surface, such as a tabletop, for use. A user can grip the handle 76 and lift the cover 70 to expose the pads 68, remove a pad, and then replace the cover within the lower cavity above the pads, re-sealing the pads and solvent from the open air.

The cover 70 prevents nail polish removing solvent that is present in the lower chamber 56 from depositing on the bottom surface of the upper container 50 when the kit is in the closed condition. Accidental damage of a tabletop or like furniture with finish-removing solvent during use of the makeup kit is therefore avoided. Additionally, the cover 70 reduces or prevents evaporation of the typically highly volatile solvent while the kit is in use without requiring the user to re-attach the upper and lower chambers.

Figure 7:
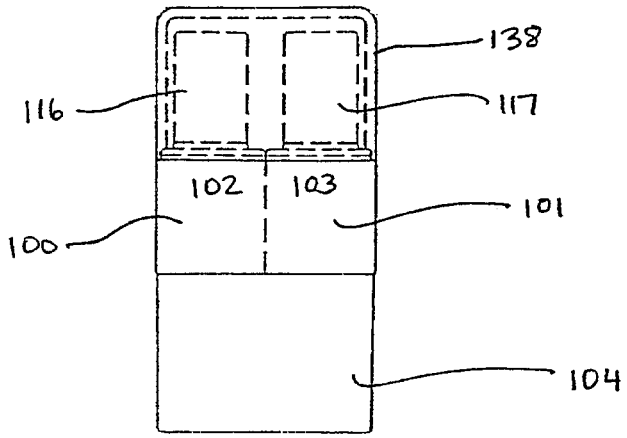
FIG. 7 is an elevation view of another embodiment of the integrated multi purpose bottle and makeup kit with two separate nail polish containers.
Figure 8:
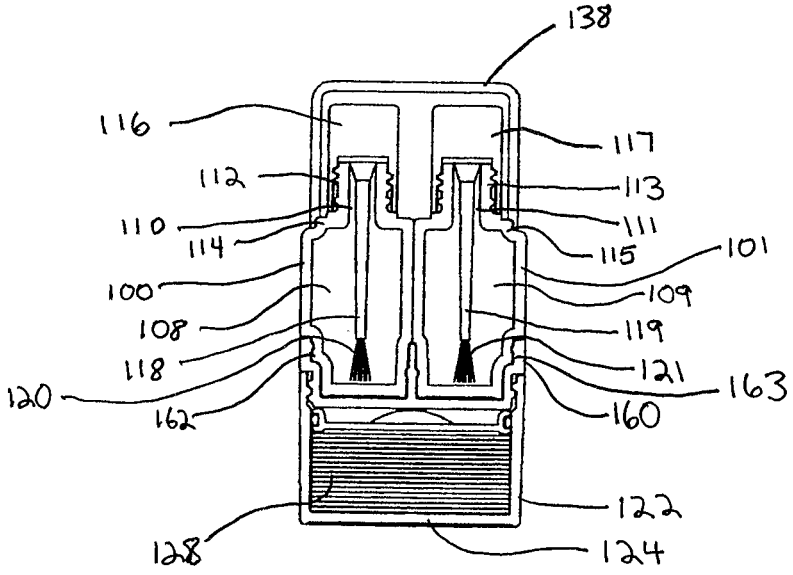
FIG. 8 is a section view of the integrated multi purpose bottle and makeup kit of FIG. 7.

With reference to FIGS. 7-9, an additional embodiment of the integrated nail makeup kit is disclosed. As can be seen, this embodiment features two separate upper containers, 100 and 101, rather than the single upper container of the previous embodiments. Each respective upper container has a side wall (102 and 103) and bottom wall (106 and 107) which respectively define separate first and second upper chambers, 108 and 109. The first and second upper containers, 100 and 101, have access apertures, 110 and 111. Each of the access apertures, 110 and 111 is formed as a bore through an externally threaded neck, 112 and 113, that extends from the top wall, 114 and 115, of the respective upper containers, 100 and 101.

As shown, each of the upper containers, 100 and 101, is fit with a cylindrical or substantially frustoconical handle, 116 and 117, that is partially hollow and fit with internal threads for mating with the external threads of the respective necks, 112 and 113. The handles, 116 and 117, can have generally identical configurations to the handle 38 of the previous embodiment, with longitudinally-extending wands, 118 and 119, fit with polish applicator brushes, 120 and 121, opposite the handles, 116 and 117.

In this embodiment, the lower container 104 is substantially identical to the lower container 12 of the previous embodiment. The lower container 104 has a substantially cylindrical side wall 122 and a substantially flat bottom wall 124 which collectively define a lower chamber 126. Within the lower chamber is disposed a plurality of pads 128 that are saturated in nail polish solvent.

Figure 9A:
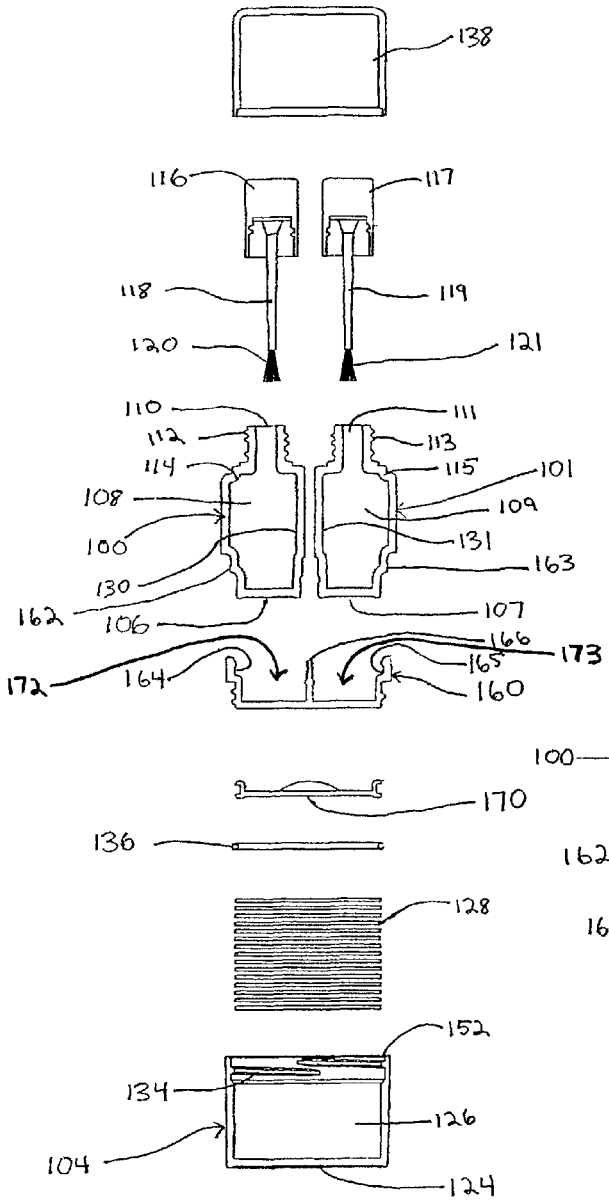
FIG. 9A is an exploded section view of FIG. 8.

As indicated in FIGS. 7-9, at least a portion of the outer surface of each of the upper container side walls, 102 and 103, is configured to allow a generally flush meeting of the respective upper containers, 100 and 101. In the depicted embodiment, each of the respective portions is generally flat (see reference numerals 130 and 131, FIG. 9A). However, other complementary configurations for these portions of the side walls are possible. Here, when the flat side wall portion 130 of the first upper container 100 is positioned against the flat side wall portion 131 of the second upper container, grooves 162 and 163 in the lower portions of the respective upper containers, are retained in ridges 164 and 165 of a bottle retainer 160. FIGS. 7 and 8 depict the makeup kit in its secured or "closed" configuration. As can be seen in FIG. 8, when in the closed configuration, the bottle retainer is capable of securing the two upper containers 100 and 101. Similar to the previous embodiments which featured a single bottom wall 20, when in the secured configuration, the bottle retainer 160 seals the lower chamber 126 from the external environment, and thus help prevent evaporation of the solvent therein.

Figure 9B:
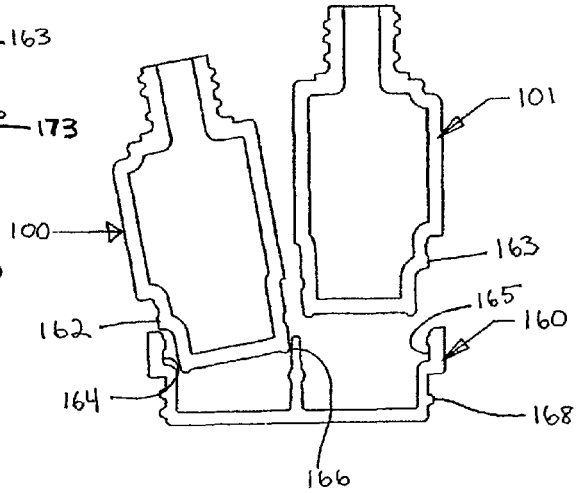
FIG. 9B is an enlarged view showing the engagement of the nail polish containers and retainer in the embodiment depicted in FIGS. 7-9A.

FIGS. 9A & 9B depict an exploded view of the embodiment depicted in FIGS. 7 and 8. Between the upper containers, 100 and 101, and lower container 104 is positioned the bottle retainer 160. The retainer 160 is configured to receive and retain the lower portion of each upper container 100 and 101. A central wall 166 separates the retainer into two wells 172 and 173. The lower portions of the respective upper containers are retained in wells 172 and 173 when the makeup kit is in the closed configuration. In this embodiment, the retainer 160 is configured for mating with the lower portion of each upper container via the retainer ridges 164 and 165 and grooves 162 and 163 in the upper container lower portions. The lower outer surface of the retainer 160 is fit with threading 168 that mates with the inner threading 134 of the lower container 104. The retainer piece allows the user to remove one or both of the upper containers 100 or 101 from the wells 172 and 173 while maintaining a hermetic seal on the lower container 104. The retainer piece allows the user to employ the upper containers 100 or 101, while simultaneously ensuring that the volatile solvent does not evaporate during use.

Like the previous embodiments, this embodiment can include a resilient O-ring 136 and impermeable cover 170 or similar sealing element positioned at the confronting surfaces of the upper periphery of the lower container 104 and the bottom of the outer surface of the retainer 160. A removable cover, such as that depicted by reference numeral 138, can be included to conceal and help prevent wear or breakage of the handles, 116 and 117. Since the first and second upper chambers, 108 and 109, are completely isolated from each other at all times, each chamber can be filled with a different color, type, or style of nail polish fluid, thus offering variety to the consumer. Notably, this embodiment of the makeup kit is not limited in shape, size or number of upper containers.

Figure 10:
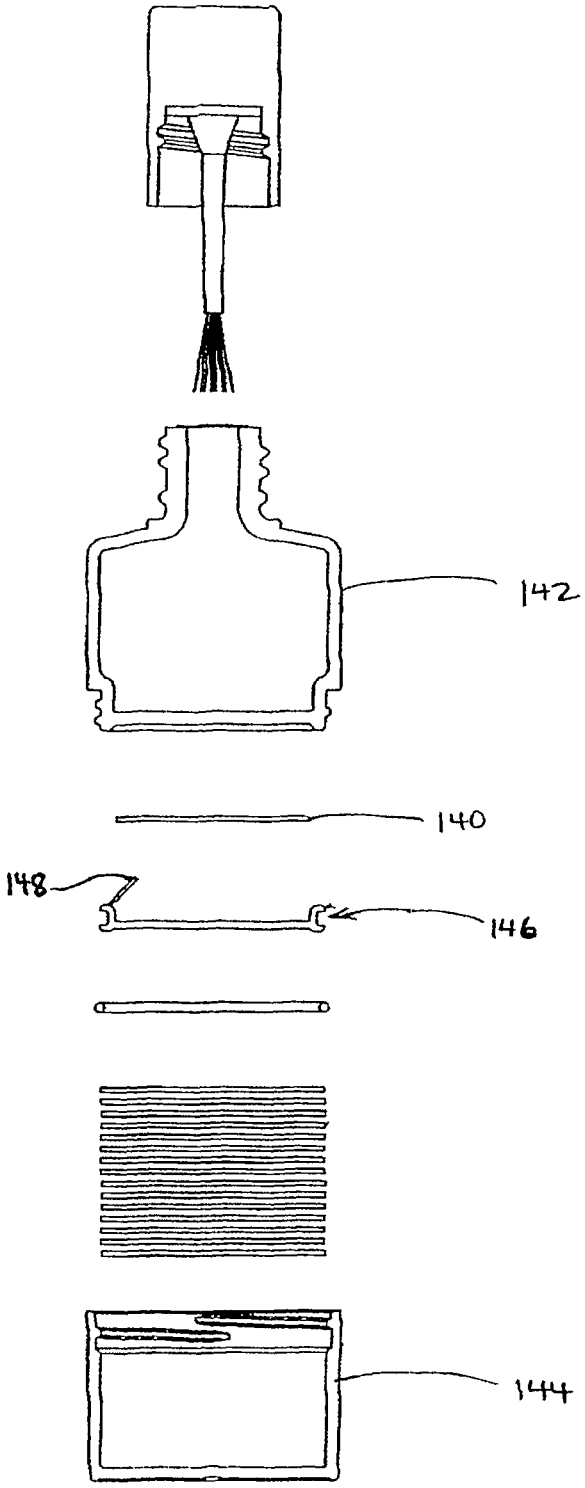
FIG. 10 is an exploded section view of another embodiment of the integrated multi purpose bottle and makeup kit having a nail file disc.

Any of the disclosed embodiments of the makeup kit can include additional beautification utensils, such as, for example the nail file or sanding disc 140 shown in FIG. 10. The nail file 140 is positioned and secured between the upper container 142 and lower container 144. Also depicted in FIG. 10 is a modification to the removable cover 146, here having a flexible tab 148 in place of a gripable handle 76 of the previous embodiment. A removable plastic or foil seal, like that depicted as reference numeral 150 in FIG. 9, can be fixed to the upper rim 152 of the lower container 104 to completely seal the lower chamber 126 prior to an initial use of a solvent saturated pad 128.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A multi-purpose makeup fluid container for use in applying and removing nail polish, comprising:

a single upper chamber defined by bottom, side, and top walls that enclose a first working volume;

a neck formed in the top wall, having exposed threads and defining an aperture into the upper chamber;

a base formed at the bottom wall, having exposed threads;

a threaded brush cap configured to selectively mate with the threads in the neck for opening and closing the aperture and including a wand with a brush that enters the first working volume through the aperture when the cap is mated with the neck and is entirely removable from the first working volume when the cap is unmated and thereafter detached from the neck;

a single lower chamber defined by bottom and side walls and an open top that partially encloses a second working volume; and a nail file positionable within the lower chamber side walls, thereby separating the second working volume from the external environment, wherein the lower chamber top includes threads sized and shaped for selective mating with the threads in the base of the upper chamber such that when the threads are mated the top of the lower chamber is closed by the bottom wall of the upper chamber and when the threads are unmated the lower chamber separates from the upper chamber and the nail file is accessible.

2. The multi-purpose makeup fluid container of claim 1, wherein the nail file is substantially flat with an outer periphery that corresponds to the shape of the lower chamber side walls.

3. The multi-purpose makeup fluid container of claim 2, wherein the second working volume contains a plurality of stacked, substantially flat pads saturated in nail polish solvent and the nail file is positionable between the pads and the upper chamber base.

4. The multi-purpose makeup fluid container of claim 1, comprising a cover for substantially fluidly sealing the second working volume from the outer environment when positioned within the side walls of the lower chamber.

5. The multi-purpose makeup fluid container of claim 1, wherein the nail file is affixed on a removable cover configured to fit within the side wall of the lower chamber for sealing the first substantially flat base from the second working volume.

6. The multi-purpose makeup fluid container of claim 5, wherein the cover comprises a flap that is gripable by an individual.

7. The multi-purpose makeup fluid container of claim 5, wherein the cover comprises a generally circular solid body defining an outer radial edge, the outer radial edge having a pair of flexible rims.

8. The multi-purpose makeup fluid container of claim 5, wherein the cover comprises a resilient O-ring at the outer radial edge for assisting in creating a substantially fluid tight seal with the lower chamber side wall.

9. The multi-purpose makeup fluid container of claim 1, wherein the second working volume contains a plurality of stacked, substantially flat pads saturated in nail polish solvent.

10. A multi-purpose makeup fluid container, comprising:

an upper chamber defined by bottom, side, and top walls that enclose a first working volume containing nail polish;

a neck formed in the top wall, having exposed threads and defining an aperture into the upper chamber;

a first substantially flat base formed at the bottom wall, having exposed threads;

a threaded brush cap configured to selectively mate with the threads in the neck for opening and closing the aperture and including a wand with a brush that enters the first working volume through the aperture when the cap is attached to the neck and is entirely removable from the first working volume when the cap is detached from the neck;

a lower chamber defined by a bottom wall including a second substantially flat base, and side walls and an open top that partially encloses a second working volume containing a plurality of fluidly saturated nail polish remover pads, a nail file with an abrasive surface positioned between the first substantially flat base and the stacked pads, wherein the lower chamber top includes threads sized and shaped for selective mating with the threads in the first base such that when the threads are mated the top of the lower chamber is closed by the bottom wall of the upper chamber and when the threads are unmated the lower chamber separates from the upper chamber whereby the nail file is exposed, and upon selective removal of the nail file, the second working volume is exposed allowing access to the pads through the open top.

11. The multi-purpose makeup fluid container of claim 10, wherein the sidewalls of the upper and lower chambers are each substantially cylindrical with substantially the same outer diameter, such that when the threads are engaged the sidewalls form a substantially continuous cylinder having a uniform outer diameter and an axial height in the range of about 2-4 inches;

the lower chamber has a substantially uniform inner diameter; and said plurality of pads are disc shaped with a diameter closely conforming to the inner diameter of the lower chamber.

12. The multi-purpose makeup fluid container of claim 10, wherein the nail file is substantially disc-shaped.

13. The multi-purpose makeup fluid container of claim 12, wherein the nail file is shaped and sized to fit within the side wall of the lower chamber.

14. The multi-purpose makeup fluid container of claim 10, comprising a cover for substantially fluidly sealing the nail polish remover pads from the outer environment when positioned within the side walls of the lower chamber.

15. The multi-purpose makeup fluid container of claim 10, wherein the nail file is affixed on a removable cover configured to fit within the side wall of the lower chamber for sealing the first substantially flat base from the pads.

16. The multi-purpose makeup fluid container of claim 15, wherein the cover comprises a generally circular solid body defining an outer radial edge, the outer radial edge having a pair of flexible rims.

17. The multi-purpose makeup fluid container of claim 15, wherein the cover comprises a resilient O-ring at the outer radial edge for assisting in creating a substantially fluid tight seal with the lower chamber side wall.

18. The multi-purpose makeup fluid container of claim 15, wherein the cover comprises a flap that is gripable by an individual.

19. An integrated multi-use kit for use in nail care, comprising:

an upper container defining a single upper chamber and an access aperture to the upper chamber and a substantially flat base, a volume of nail polish being within the upper chamber;

a lower container selectively engaged with the upper container and defining a single lower chamber that is fluidly isolated from the upper chamber whether the containers are attached or detached, the lower container having a substantially flat base;

a plurality of substantially flat pads saturated with solvent for nail polish stacked within the lower chamber;

a threaded cap having a brush wand extending into the upper chamber and selectively attachable to the upper container at the aperture for opening and closing the aperture; and a nail file with an abrasive surface positioned between the upper container base and the stacked pads; wherein the upper container and lower container when attached together can be placed self-standing with the base of the lower container, and upon selective disengagement and subsequent detachment of the lower container from the upper container, the nail file is accessible and can be separated from the upper and lower containers, and the pads in the second chamber are directly accessible for removal, and both the upper container and lower containers can be placed self-standing on their respective bases.

* * * * *